US009341354B2

(12) United States Patent
Pardikes et al.

(10) Patent No.: US 9,341,354 B2
(45) Date of Patent: May 17, 2016

(54) LINEAR LED LIGHT MOUNTING SYSTEM

(71) Applicant: TerraLUX, Inc., Longmont, CO (US)

(72) Inventors: Brett James Pardikes, Arvada, CO (US); Steven Howard Ray, Longmont, CO (US)

(73) Assignee: TerraLUX, Inc., Longmont, CO (US)

( * ) Notice: Subject to any disclaimer, the term of this patent is extended or adjusted under 35 U.S.C. 154(b) by 92 days.

(21) Appl. No.: 14/074,764

(22) Filed: Nov. 8, 2013

(65) Prior Publication Data

US 2014/0133150 A1 May 15, 2014

Related U.S. Application Data

(60) Provisional application No. 61/725,588, filed on Nov. 13, 2012.

(51) Int. Cl.

| | |
|---|---|
| ***F21V 21/26*** | (2006.01) |
| ***F21V 21/005*** | (2006.01) |
| ***F21V 21/02*** | (2006.01) |
| *F21V 21/116* | (2006.01) |
| *F21Y 101/02* | (2006.01) |

(52) U.S. Cl.
CPC ..... *F21V 21/005* (2013.01); *F21V 21/02* (2013.01); *F21Y 2101/02* (2013.01)

(58) Field of Classification Search
CPC ..... F21S 8/043; F21V 15/015; F21V 17/00; F21V 17/02; F21V 17/002; F21V 17/005; F21V 17/06; F21V 17/10; F21V 17/104; F21V 19/0045; F21V 21/025; F21V 21/088–21/0885; F21V 21/108; F21V 21/10; F21V 21/26; F21V 21/30
USPC ..... 362/177, 220
See application file for complete search history.

(56) References Cited

U.S. PATENT DOCUMENTS

| | | | | |
|---|---|---|---|---|
| 6,120,163 | A * | 9/2000 | Graber | F21L 14/026 362/223 |
| 7,777,430 | B2 * | 8/2010 | Catalano | H05B 33/0803 315/185 S |
| D687,581 | S | 8/2013 | Pardikes et al. | |
| 2011/0051407 | A1 * | 3/2011 | St. Ives | F21V 15/015 362/225 |

FOREIGN PATENT DOCUMENTS

| | | | | |
|---|---|---|---|---|
| WO | WO 2013063247 | A1 * | 5/2013 | F21V 21/00 |

* cited by examiner

*Primary Examiner* — Anh Mai
*Assistant Examiner* — Nathaniel Lee
(74) *Attorney, Agent, or Firm* — Neugeboren O'Dowd PC

(57) ABSTRACT

In various embodiments, a system for providing an LED illumination source on a surface includes a light module comprising (i) an illumination area for receiving one or more light-emitting diodes (LEDs) and (ii) slip joints at first and second ends of the light module, each slip joint comprising a slip joint slot, and at least one bracket for mounting the light module to the surface, the at least one bracket having (i) a fitting frictionally receivable within one of the slip joint slots and (ii) a mounting region engageable to the surface.

23 Claims, 6 Drawing Sheets

LINEAR LED LIGHT MOUNTING SYSTEM

RELATED APPLICATION

This application claims the benefit of and priority to U.S. Provisional Patent Application No. 61/725,588, filed Nov. 13, 2012, the entire disclosure of which is hereby incorporated herein by reference.

FIELD OF THE INVENTION

In various embodiments, the present invention relates to illumination devices, in particular mounting systems for illumination devices incorporating light-emitting diodes.

BACKGROUND

Illumination modules based on light-emitting diodes (LEDs) represent an attractive alternative to incandescent lamps due to their smaller form factor, lower energy consumption, longer operational lifetime, and/or enhanced mechanical robustness. LED light modules also tend to generate less waste heat than incandescent lamps. LED chips approximate point sources of light and may be contained within packages that direct the LED light having a variety of different form factors and sizes. While such design flexibility can lead to innovative products difficult to reproduce with incandescent bulbs, LED lighting modules do present challenges. For example, while LEDs tend to produce less heat than incandescent lighting, they do produce heat that may require dissipation in order to preserve the operational capabilities of the LED light over an expected lifetime. Furthermore, each individual LED or LED-based lighting module may produce insufficient light for particular applications (e.g., illumination of large areas or of paths with complicated footprints or shapes). While multiple LED-based light sources may be utilized in such applications, the packaging for many conventional LED-based light sources is not designed to facilitate the interconnection of several different light sources to form a single illumination region emitting light that is of substantially uniform intensity over its area.

In light of the foregoing, there is a need for LED-based lighting devices having a modular mounting system that can accommodate multiple LED light modules without risking damage to any of them, facilitate heat conduction away from the modules, and produce uniform illumination, the emission direction of which may be easily changed on a module-by-module basis.

SUMMARY

In accordance with various embodiments of the invention described herein, a mounting system is used to facilitate attachment of multiple LED light modules together and/or to a lighting fixture (e.g., a flat metal surface) that may include a heat sink, thereby forming an illumination system. An illumination system in accordance with the current invention may include multiple LED modules. Each module may include slip joint slots in both ends that connect to another module using, e.g., mounting brackets, thereby allowing a new module to attach to or detach from the illumination system conveniently and with no damage thereto. Each module may be secured, and thus be oriented to emit light, in either the horizontal or vertical direction independent of the orientation of the other modules. Additionally, the distance between each LED module in the illumination system is limited such that the system produces spatially uniform light.

In one aspect, embodiments of the invention feature a system for providing an LED illumination source on a surface. The system includes or consists essentially of a light module comprising (i) an illumination area for receiving one or more light-emitting diodes (LEDs) and (ii) slip joints at first and second ends of the light module, each slip joint comprising a slip joint slot, and at least one bracket for mounting the light module to the surface, the at least one bracket having (i) a fitting frictionally receivable within one of the slip joint slots and (ii) a mounting region engageable to the surface.

Embodiments of the invention feature one or more of the following in any of a variety of combinations. The fitting of the at least one bracket may be rotatable within the slip joint slot when frictionally engaged therein. At least a portion of slip joint slot may have a circular shape. A first distance between a center of the circular shape and a first edge of the slip joint may be substantially equal to a second distance between the center of the circular shape and a second edge of the slip joint perpendicular to the first edge of the slip joint. The fitting may include a shaft projecting from the bracket and a disc, affixed to a distal end of the shaft, for sliding into the slip joint slot. The mounting region may include a mounting feature having a flat surface substantially perpendicular to a surface of the disc. The illumination area may include or consist essentially of one or more LEDs disposed beneath a substantially transparent or substantially translucent cover.

In another aspect, embodiments of the invention feature an illumination system that includes or consists essentially of (a) a plurality of light modules each including or consisting essentially of (i) an illumination area for receiving one or more light-emitting diodes (LEDs) and (ii) slip joints at first and second ends of the light module, each slip joint including a slip joint slot, (b) a first bracket for interconnecting two light modules, the first bracket including or consisting essentially of (i) an arm, (ii) a first disc disposed at a first end of the arm on a first side thereof, (iii) a second disc disposed at the first end of the arm on a second side thereof opposite the first side, the second disc opposing the first disc and being substantially parallel thereto, and (iv) a mounting feature disposed at a second end of the arm, (c) a second bracket for mounting the plurality of light modules to the surface, the second bracket including or consisting essentially of (i) an arm, (ii) a disc disposed at a first end of the arm on a first side thereof, and (iii) a mounting feature disposed at a second end of the arm, and (d) a third bracket for mounting the plurality of light modules to the surface, the third bracket including or consisting essentially of (i) an arm, (ii) a disc disposed at a first send of the arm on a first side thereof, and (iii) a mounting feature disposed at a second end of the arm. When the mounting feature of the third bracket and the mounting feature of the second bracket are disposed on the surface substantially parallel to each other, the discs of the third bracket and the second bracket face in opposite directions. The slip joint slots of the light modules are configured for frictionally and rotatably engaging (i) the first disc of the first bracket, (ii) the second disc of the first bracket, (iii) the disc of the second bracket, and/or (iv) the disc of the third bracket.

Embodiments of the invention feature one or more of the following in any of a variety of combinations. The illumination areas of at least two light modules may be oriented to emit light in directions substantially perpendicular to each other. The illumination areas of at least two light modules may be oriented to emit light in substantially the same direction. The first disc of the first bracket, the second disc of the first bracket, the disc of the second bracket, and/or the disc of the third bracket may be circular. Any two of (or even all of)

the first disc of the first bracket, the second disc of the first bracket, the disc of the second bracket, and/or the disc of the third bracket may have substantially identical diameters. Rach light module may approximately define a regular rectangular solid having the illumination area disposed on one surface thereof. The slip joints of the light module may be disposed at first and second opposing ends of the light module substantially perpendicular to the illumination area. The illumination area may include or consist essentially of one or more LEDs and a curved, substantially transparent or substantially transparent cover disposed over the one or more LEDs.

These and other objects, along with advantages and features of the invention, will become more apparent through reference to the following description, the accompanying drawings, and the claims. Furthermore, it is to be understood that the features of the various embodiments described herein are not mutually exclusive and can exist in various combinations and permutations. As used herein unless otherwise indicated, the terms "substantially" and "approximately" mean±10%, and, in some embodiments, ±5%. The term "consists essentially of" means excluding other materials that contribute to function, unless otherwise defined herein. Nonetheless, such other materials may be present, collectively or individually, in trace amounts.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Figure 1A:
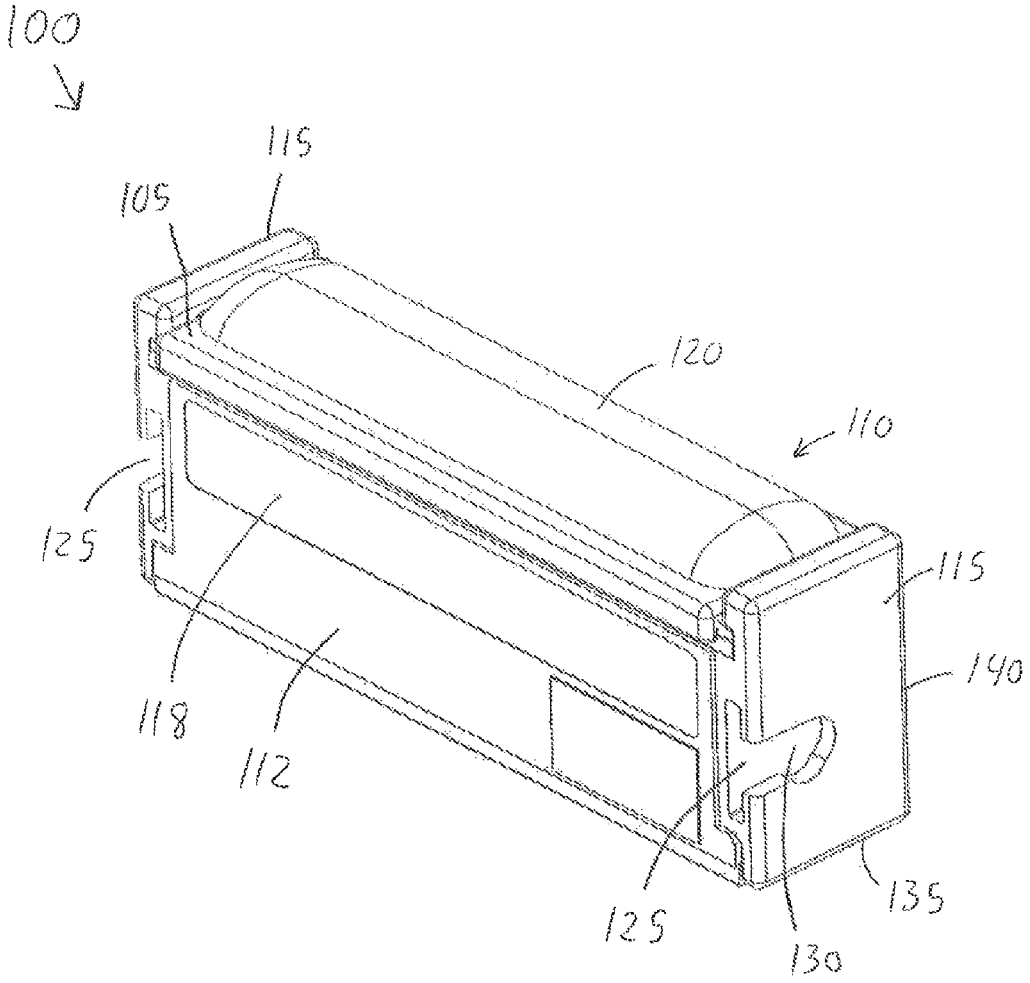
FIGS. 1A and 1B are isometric representations of LED-based lighting modules usable in accordance with various embodiments of the invention.
Figure 1B:
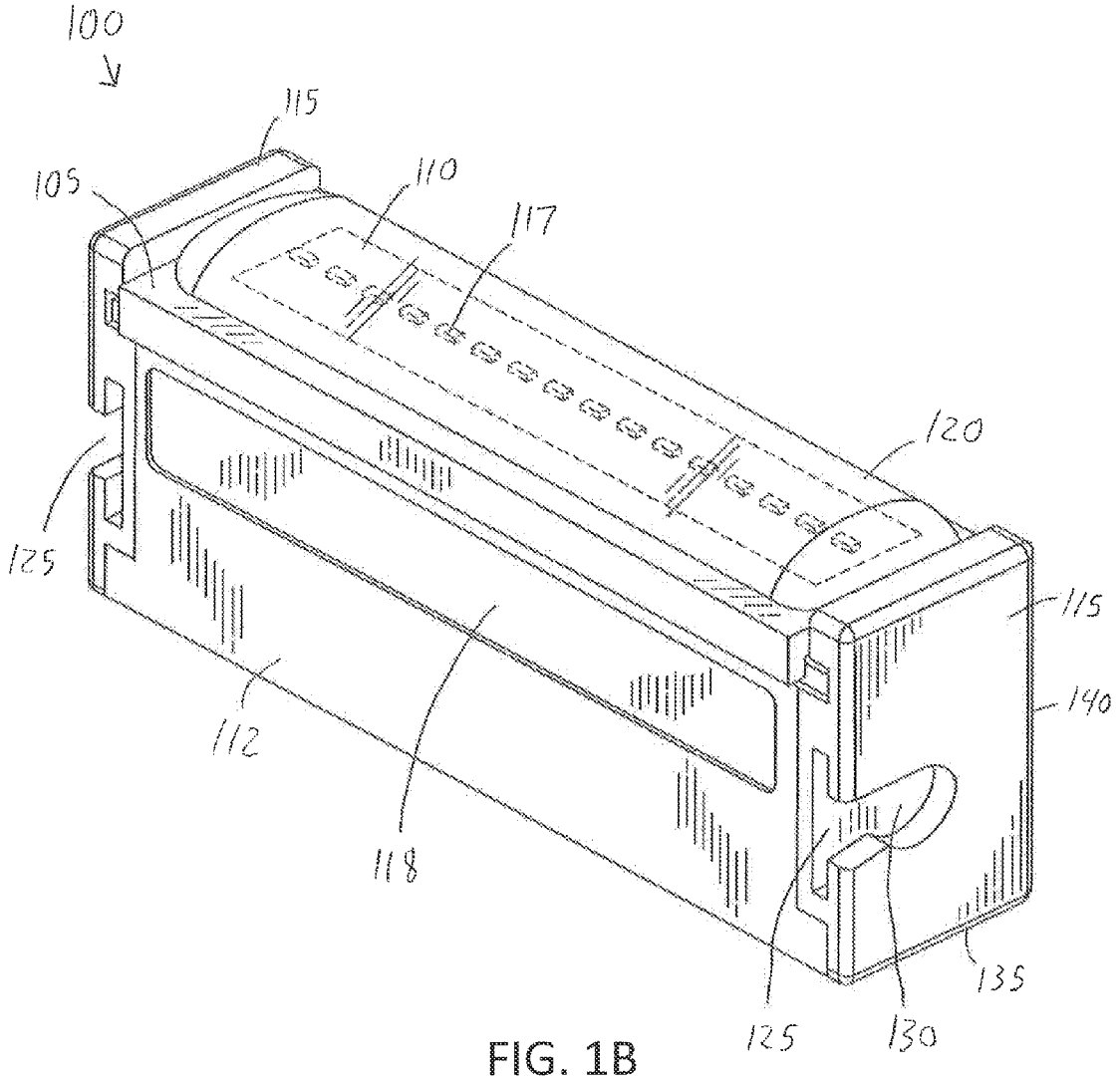

FIG. 1A illustrates an LED light module 100 that has a surface 105 for supporting and securing an LED illumination element 110, a module body 112, and two slip joints 115 at opposed ends of the light module body 112. The slip joints 115 may be portions of the module body 112 as opposed to, e.g., discrete parts attached to module body 112. In some embodiments the light module 100 has a slip joint on only one end of the module body 112, and the opposing end may thus not be configured for attachment thereto. As shown in FIG. 1B, the LED illumination element 110 may include one or more discrete bare-die and/or packaged LEDs 117 that may be disposed beneath a cover 120 (e.g., a substantially transparent or translucent cover such as a lens). (Although FIG. 1B illustrates LEDs 117 disposed in a single linear array, embodiments of the present invention include other arrangements of one or more LEDs 117 within the LED illumination element 110, including two-dimensional regular and pseudo-random arrays.) The slip joints 115 typically each feature a slot 125 that allows the light module 100 to be mounted to a light fixture (e.g., a flat surface such as a metal surface, or a surface within a lamp or other lighting device) or to be connected to another light module 100 via, for example, a mounting bracket as detailed below.

The light module body 112 preferably contains electronics that transform electrical power into a form suitable to drive the LEDs 117 (e.g., DC current). Light module body 112 may also include dimmers, transformers, rectifiers, or ballasts suitable for operation with the LEDs 117, as understood by those of skill in the art, and such components (and/or any other circuitry) of light module body 112 may be disposed on a printed circuit board. In preferred embodiments, the light module body 112 also provides for thermal feedback (or "foldback") to protect the LEDs 117, as described in, e.g., U.S. Pat. No. 7,777,430 and U.S. Patent Application Publication Nos. 2010/0320499, 2010/0176746 (the '6746 application), and 2011/0121760, the entire disclosures of which are incorporated by reference herein. For example, the temperature sensed at the lighting module 100 may be utilized to provide over-temperature protection (i.e., reduction in the power supplied to the LEDs 117) and/or switch and control any active cooling system (e.g., a fan) incorporated within light module body 112 via, e.g., thermal control electronics. The light module body 112 may even incorporate features described in the '6746 application to enable two-wire temperature sensing and, thus, the maintaining of the LEDs 117 within a safe operating temperature range. The module body 112 may also contain a power source (e.g., one or more batteries) and/or wiring and/or a socket for interconnection of the module 100 to an external power source (e.g., an AC main). The module body 112 may also include an exterior panel 118 for displaying module-related information such as a part number, a company logo (see FIG. 2), decorative text and/or graphics, etc.

Figure 2:
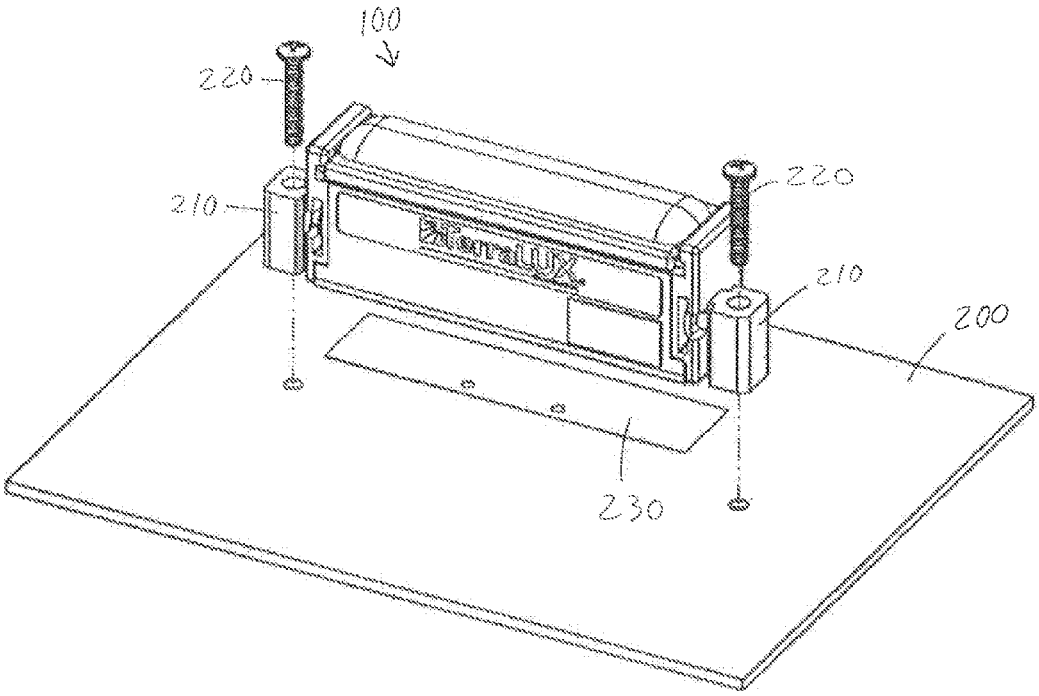
FIG. 2 is a depiction of the attachment of the lighting module of FIG. 1A to a planar fixture in accordance with various embodiments of the invention.

FIG. 2 depicts an LED light module 100 being secured to a flat fixture 200. The LED light module 100 is mounted to fixture 200 via two through-hole mounting brackets 210 extending from the module body 112; using the brackets 210 and screws 220 (or other fasteners such as nails, staples, etc.), the module 100 is attached to the fixture 200. As shown, the fixture 200 may incorporate therein or thereon a thermally conductive material such as a heat sink 230. The heat produced by module 100 during operation may then be effectively conducted away from the LED module 100. As shown, when module 100 is fastened to the flat fixture 200, the light emitted from the LED module 100 is typically emitted in only one direction (e.g., the vertical direction away from fixture 200); alteration of the light-emission direction typically requires detachment and reattachment of the lighting module 100. One potential disadvantage of the use of through-hole mounting brackets 210 is their size and lateral extent away from the sides of the module body 112, which results from the need to accommodate the screw 220 for attachment. Thus, if multiple LED light modules 100 are arranged end-to-end in this manner, the space between each pair of modules 100 is at least two times of the width of the brackets 210; this spacing may result in visibly non-uniform light output and/or inefficient utilization of illumination area.

Figure 3A:
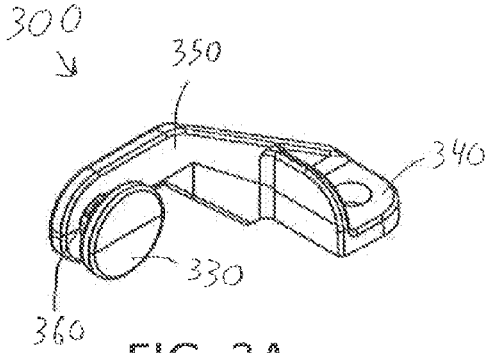
FIGS. 3A-3C are depictions of different mounting brackets usable in accordance with various embodiments of the invention.
Figure 3C:
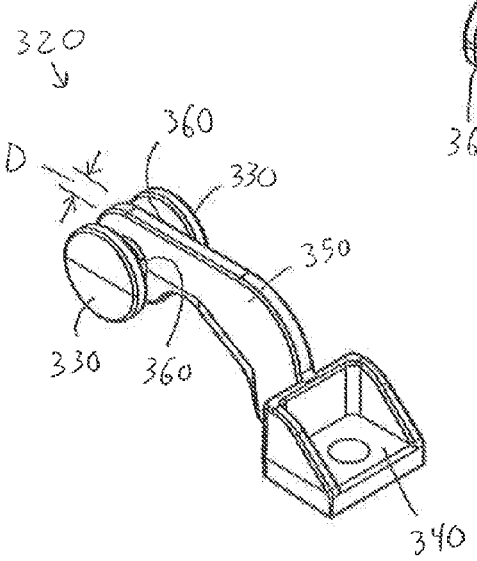
Figure 3B:
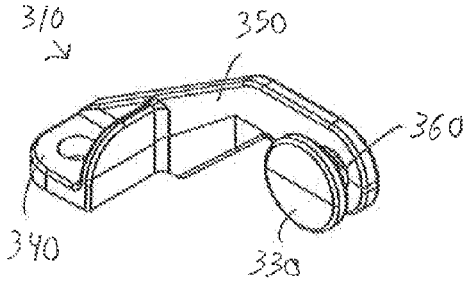
Figure 3D:
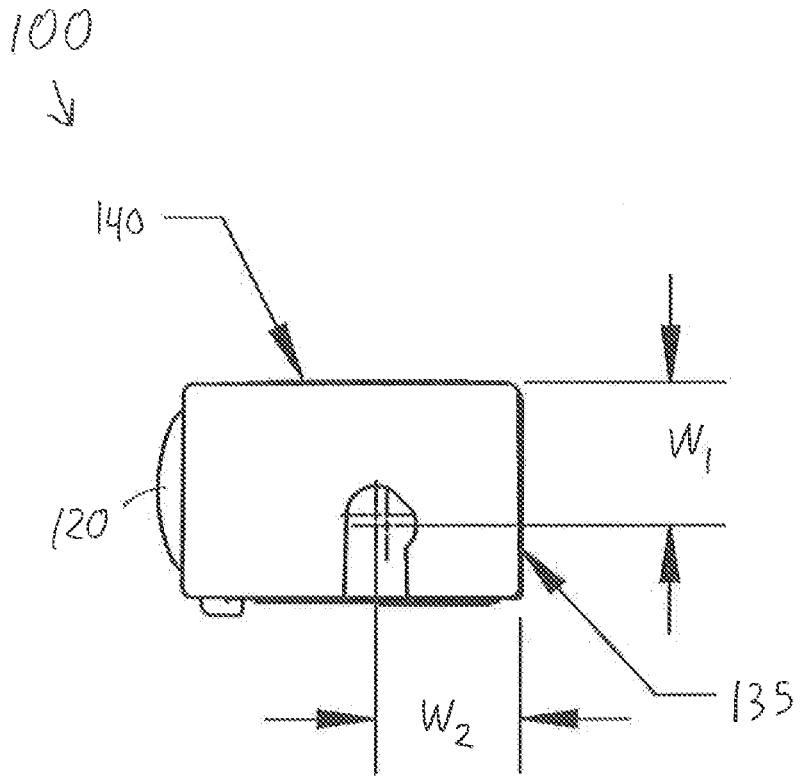
FIG. 3D is a side-view of the lighting module of FIG. 1A in accordance with various embodiments of the invention.

Referring to FIGS. 3A-3C, in various embodiments of the present invention, mounting brackets 300, 310, 320 each have a disc feature 330 on one side or both sides of one end, a flat mounting foot 340 on the other end and an arm 350 therebetween. The disc 330 connects to the arm 350 via a shaft 360 having a cross-sectional diameter or width smaller than the diameter of the disc 330. As shown, the mounting brackets may have various geometries, for example, a left-facing single-mounting configuration 300, a multi-mounting configuration 320 with an opposed pair of discs 330, or a right-facing single-mounting configuration 310, depending on space requirements and the geometry of the slip joint slots 125. If one LED light module 100 is sufficient for lighting, the mounting bracket 300 and/or the mounting bracket 310 each having only a single disc 330 on one end may be used to mount the light module 100 to the fixture via the flat mounting foot 340. The disc 330 first slides into the slip joint slot 125 with the shaft 360 passing through a keyhole 130. The keyhole 130 has a diameter or width larger than that of the shaft 360 but smaller than that of the disc 330, so that the disc 330 is retained within the slip joint slot 125; desirably, the slip joint slot 125 is wide enough to accommodate the disc 330 but frictionally engages it as the disc 330 is received therein. The flat mounting foot 340 of the bracket 300, 310, or 320 may be mechanically fastened to the fixture or, e.g., a heat sink, using, for example, a screw, nail, staple, or other fastener, thereby securing the light module 100 to the fixture. Once the flat mounting foot 340 is fastened to a surface or fixture, the bracket 300, 310, and/or 320 prevents physical translation of the light module 100 without the light module 100 itself being otherwise fastened (e.g., by an adhesive) to the surface or fixture. At least portions of the slip joint slot 125 and/or the keyhole 130 may each have a circular shape conforming to the disc 330 and the shaft 360, respectively. With reference to FIG. 3D, the distance $W_1$ between the center of the keyhole 130 (or a circular-shaped portion thereof) and a bottom surface 135 of the slip joint slot 125 may be approximately equal to the distance $W_2$ between the center of the keyhole 130 (or a circular-shaped portion thereof) and a side surface 140 such that LED light modules attached together may be rotatable about a single axis. Thus, light modules 100 having the same orientation will be approximately coplanar even if separated by one or more other light modules 100 having different orientations. Furthermore, the emission directions of the LED light modules 100 may be independently oriented in a vertical direction (e.g., an x-direction) or a horizontal direction (e.g., a y-direction), or any orientation therebetween, thereby generating various focal points of light as desired.

Figure 4:
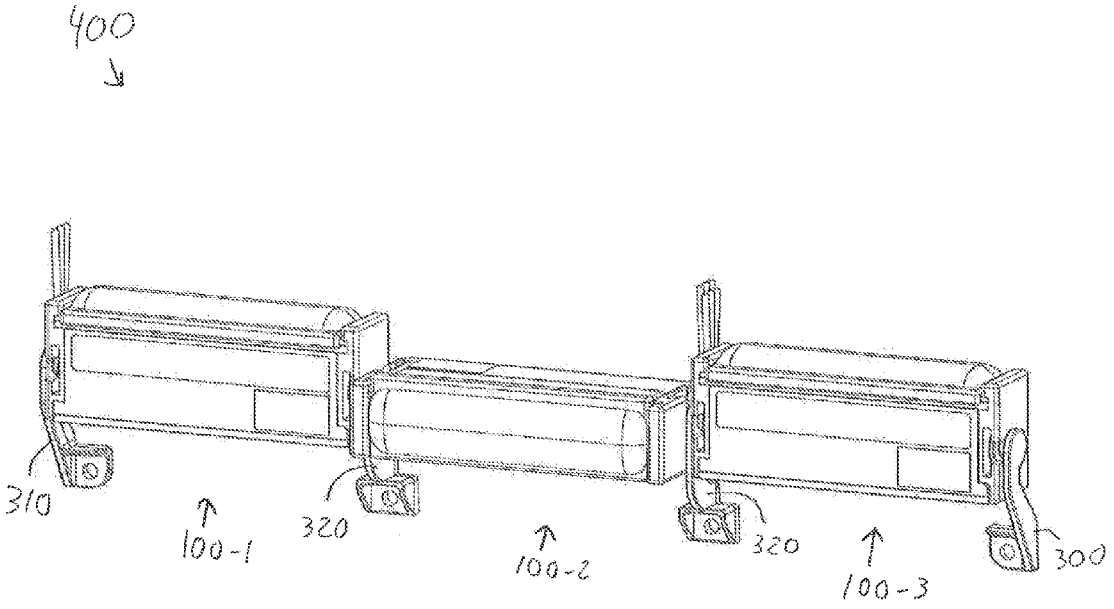
FIG. 4 is a depiction of an illumination system feature three lighting modules linked together and mounted to a common fixture in accordance with various embodiments of the invention.

Referring to FIG. 4, if a lighting system 400 requires multiple LED light modules 100, these modules may be connected by sliding a mounting bracket 320 with discs 330 on both sides into the slip joint slots 125 of adjacent modules 100. The orientation of the light modules 100 (and consequently, the primary emission direction of the LED light therefrom) may be arranged independently, thereby generating various focal points of light. For example, as illustrated in FIG. 4, light modules 100-1 and 100-3 emit vertical light (in the x-direction) and light module 100-2 emits horizontal light (in the y-direction). Additionally, because the end-to-end distance between the consecutive light fixtures is limited (approximately a width D of the bracket arm 350, as shown in FIG. 3C), the LED light generated by the integrated lighting system 400 is uniform and distributed evenly. Further, because a new module may be attached to an existing module by simply sliding the slip joint slot onto the free disc of the mounting bracket 320, embodiments of the current invention obviate the need for disassembly of the existing system 400 when expanding it, thereby preventing potential damage to the light modules and/or sensitive optics therein. In one embodiment, various parameters of the module 100, such as the size of the slip joint slot, and/or the geometry of the mounting bracket, such as the diameter of the disc and the width and length of the arm, are standardized such that various sizes of light modules with standardized slot sizes may be integrated together into a single illumination system.

At both ends of the lighting system 400—i.e., the slip joint slots 125 that do not connect to other light modules—a mounting bracket 300 and/or a mounting bracket 310 that has a disc 330 on one side only may be received within slots and then used to mount the entire lighting system 400 to a fixture via flat mounting feet 340. The flat mounting feet 340 of the mounting brackets 320 that each connect two light fixtures 100 together may be mechanically fastened to the fixture to provide additional support for the weight of lighting system 400 and to dissipate at least some of the heat generated by the modules 100. If it is desirable to attach a new module to the existing chain of modules, one of the mounting brackets 300, 310 may first be detached from the fixture and replaced by a bracket 320 that has two discs 330.

The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A system for providing an LED illumination source on a surface, the system comprising:

a light module comprising (i) an illumination area for receiving one or more light-emitting diodes (LEDs) and (ii) slip joints at first and second ends of the light module, each slip joint comprising a slip joint slot, and at least one bracket for mounting the light module to the surface, the at least one bracket having (i) a fitting frictionally receivable, along a direction of insertion, within one of the slip joint slots and (ii) a mounting region engageable to the surface, wherein each slip joint slot extends only partially through the slip joint along the direction of insertion; and wherein each slip joint is configured such that, when the fitting of the bracket is received at a terminus of the slip joint slot along the direction of insertion, the fitting of the bracket is approximately centered, in the direction of insertion, along one of the ends of the light module.

2. The system of claim 1, wherein the fitting of the at least one bracket is rotatable within the slip joint slot when frictionally engaged therein.

3. The system of claim 2, wherein at least a portion of slip joint slot has a circular shape.

4. The system of claim 3, wherein a first distance between a center of the circular shape and a first edge of the slip joint is substantially equal to a second distance between the center of the circular shape and a second edge of the slip joint perpendicular to the first edge of the slip joint.

5. The system of claim 1, wherein the fitting comprises a shaft projecting from the bracket and a disc, affixed to a distal end of the shaft, for sliding into the slip joint slot.

6. The system of claim 5, wherein the mounting region comprises a mounting feature having a flat surface substantially perpendicular to a surface of the disc.

7. The system of claim 1, wherein the illumination area comprises one or more LEDs disposed beneath a substantially transparent or substantially translucent cover.

8. The system of claim 1, wherein each slip joint slot comprises a keyhole having (i) an open end for receiving the fitting of a bracket and (ii) a closed end for preventing translation of the fitting of the bracket out of the slip joint in a direction opposite the open end.

9. The system of claim 8, wherein, for each slip joint slot, a width of the open end is smaller than a width or diameter of the closed end.

10. The system of claim 1, wherein the at least one bracket is configured to receive one or more fasteners at least partially therein to affix the at least one bracket to the surface.

11. The system of claim 10, wherein the one or more fasteners comprise at least one of a nail, a screw, or a staple.

12. The system of claim 1, wherein the light module comprises circuitry for thermal-foldback protection of the one or more LEDs.

13. An illumination system comprising:

a plurality of light modules each comprising (i) an illumination area for receiving one or more light-emitting diodes (LEDs) and (ii) slip joints at first and second ends of the light module, each slip joint comprising a slip joint slot;

a first bracket for interconnecting two light modules, the first bracket comprising (i) an arm, (ii) a first disc disposed at a first end of the arm on a first side thereof, (iii) a second disc disposed at the first end of the arm on a second side thereof opposite the first side, the second disc opposing the first disc and being substantially parallel thereto, and (iv) a mounting feature disposed at a second end of the arm;

a second bracket for mounting the plurality of light modules to the surface, the second bracket comprising (i) an arm, (ii) a disc disposed at a first end of the arm on a first side thereof, and (iii) a mounting feature disposed at a second end of the arm; and a third bracket for mounting the plurality of light modules to the surface, the third bracket comprising (i) an arm, (ii) a disc disposed at a first send of the arm on a first side thereof, and (iii) a mounting feature disposed at a second end of the arm, wherein, when the mounting feature of the third bracket and the mounting feature of the second bracket are disposed on the surface substantially parallel to each other, the discs of the third bracket and the second bracket face in opposite directions, wherein the slip joint slots of the light modules are configured for frictionally and rotatably engaging at least one of (i) the first disc of the first bracket, (ii) the second disc of the first bracket, (iii) the disc of the second bracket, or (iv) the disc of the third bracket.

14. The system of claim 13, wherein the illumination areas of at least two light modules are oriented to emit light in directions substantially perpendicular to each other.

15. The system of claim 13, wherein the illumination areas of at least two light modules are oriented to emit light in substantially the same direction.

16. The system of claim 13, wherein (i) the first disc of the first bracket, (ii) the second disc of the first bracket, (iii) the disc of the second bracket, and (iv) the disc of the third bracket are circular.

17. The system of claim 16, wherein (i) the first disc of the first bracket, (ii) the second disc of the first bracket, (iii) the disc of the second bracket, and (iv) the disc of the third bracket have substantially identical diameters.

18. The system of claim 13, wherein (i) each light module approximately defines a regular rectangle solid having the illumination area disposed on one surface thereof, (ii) the slip joints of the light module are disposed at first and second opposing ends of the light module substantially perpendicular to the illumination area, and (iii) the illumination area comprises a curved, substantially transparent or substantially translucent cover disposed over one or more LEDs.

19. The system of claim 13, wherein each slip joint slot comprises a keyhole having (i) an open end for receiving a disc and (ii) a closed end for preventing translation of the disc out of the slip joint slot in a direction opposite the open end.

20. The system of claim 19, wherein, for each slip joint slot, a width of the open end is smaller than a width or diameter of the closed end.

21. The system of claim 19, wherein, for each slip joint slot, the closed end is positioned such that, when the disc is received within the closed end, the disc is approximately centered along one of the ends of a light module.

22. The system of claim 13, wherein each light module comprises circuitry for thermal-foldback protection of the one or more LEDs.

23. A system for providing an LED illumination source on a surface, the system comprising:

a light module comprising (i) an illumination area for receiving one or more light-emitting diodes (LEDs) and (ii) slip joints at first and second ends of the light module, each slip joint comprising a slip joint slot, and at least one bracket for mounting the light module to the surface, the at least one bracket having (i) a fitting frictionally receivable, along a direction of insertion, within one of the slip joint slots and (ii) a mounting region engageable to the surface, wherein each slip joint slot extends only partially through the slip joint along the direction of insertion;

wherein each slip joint slot comprises a keyhole having (i) an open end for receiving the fitting of a bracket and (ii) a closed end for preventing translation of the fitting of the bracket out of the slip joint in a direction opposite the open end; and wherein, for each slip joint slot, the closed end is positioned such that, when the fitting of the bracket is received within the closed end, the fitting of the bracket is approximately centered, in the direction of insertion, along one of the ends of the light module.

* * * * *